US006200643B1

(12) United States Patent
Sugai et al.

(10) Patent No.: US 6,200,643 B1
(45) Date of Patent: Mar. 13, 2001

(54) METHODS FOR COATING SUBSTRATES

(76) Inventors: Isao Sugai, 13-9, Enoki-cho, Tokorozawa-shi, Saitama 359-1104; Atsuo Kusubiki, 1-5-6, Kamiaokinishi, Kawaguchi-shi, Saitama 333-0845, both of (JP)

( * ) Notice: Subject to any disclaimer, the term of this patent is extended or adjusted under 35 U.S.C. 154(b) by 0 days.

(21) Appl. No.: 09/346,171

(22) Filed: Jul. 1, 1999

(30) Foreign Application Priority Data

Jul. 1, 1998 (JP) ..... 10-186256

(51) Int. Cl.[7] ..... B05D 1/04
(52) U.S. Cl. ..... 427/475; 427/474; 427/476
(58) Field of Search ..... 427/473, 474, 427/475, 476, 600

(56) References Cited

U.S. PATENT DOCUMENTS 2,742,185 * 4/1956 Landry .
3,917,880 11/1975 Wells et al. .
3,953,618 4/1976 Muntz et al. .
4,377,603 * 3/1983 Itoh et al. .
4,780,331 * 10/1988 Cobbs, Jr. et al. .
5,279,863 * 1/1994 Escallon .
5,445,852 * 8/1995 Sugai .

FOREIGN PATENT DOCUMENTS 2 253 164 * 2/1992 (GB) .

* cited by examiner

*Primary Examiner*—Fred J. Parker
(74) *Attorney, Agent, or Firm*—Oblon, Spivak, McClelland, Maier & Neustadt, P.C.

(57) ABSTRACT

A method for coating a substrate comprising the steps of disposing a non-conductive substrate within a space, introducing particles of a coating material within the space, the space being defined by at least a pair of electrodes and an insulating member inserted between the electrodes, and vibrating the particles by applying an ac voltage between the electrodes so as to coat the non-conductive substrate with the coating material.

16 Claims, 8 Drawing Sheets

METHODS FOR COATING SUBSTRATES

BACKGROUND OF THE INVENTION

The present invention relates to a method of coating a non-conductive substrate.

Coating a substrate with a metal or a metal compound is widely conducted for corrosion protection, decoration, reinforcement and the like. The representative examples of prior art methods for coating a substrate include electroplating, vacuum deposition, and spraying.

Electroplating is a method of depositing a metal ion by an electrochemical reaction on an electrode dipped in a plating solution. This technique has disadvantages such as the types of coating materials being limited. In addition, only a coating in the order of a few microns is formed because a thick coating is difficult to form. In addition, electroplating is not an economical method because it requires a complicated large-scale system and a large amount of electric power so that production cost is high. When a plating solution containing cyanogen, sodium hydroxide, or ammonia is used, plating efficiency and recovery rate of a coating material are low and waste disposal of the plating solution causes serious problems on preservation of environment. In the case of melt plating, a melted coating material tends to react with a substrate to be coated because the coating treatment is conducted at a high temperature.

On the other hand, vacuum deposition is a method of vacuum coating either by heating a target material placed on a filament or kept in a crucible by a heating resistor, electron beam or laser light, or by ion-sputtering of a target material. Although laser-heating and ion-sputtering can be conducted at a relatively low temperature compared with other vacuum deposition techniques, they can not eliminate such disadvantages as a crucible causing contamination and coating materials reacting with each other or with a substrate so that an alloy is formed because the laser-heating and ion-sputtering are classified as high-temperature coating methods using thermal melting. In addition, since particles vacuum-evaporated or sputtered from a target are so active as to react with residual gas to provide impurities, a coating having high purity can not be obtained. Moreover, coating efficiency and recovery rate of a coating material are low. The coating obtained by this method has low adhesion to a substrate and hence is not highly durable. Furthermore, when a substrate having a large area is coated, a coating having uniform thickness can not be obtained.

Spray coating is a method of coating a substrate by spraying a coating solution from a nozzle onto a substrate. This method is simpler than the above two methods. However, spraying has the disadvantage that a coating has low adhesion to a substrate and low density. In addition, this method is not economical because it requires special steps such as pre-washing of the substrate surface, pre-treatments for providing the substrate with adherability to a coating, a drying step and the like.

If the substrate to be coated has a complicated shape, for example, if the inner surface of a hollow cylinder is to be coated, a uniform coating can not be obtained by using any of the above methods.

SUMMARY OF THE INVENTION

Accordingly, an object of the present invention is to provide a method of coating a substrate which overcomes the afore-mentioned disadvantages of the prior art.

Namely, the object of the present invention is to provide a method of coating a substrate which makes it possible to efficiently form a coating having high adhesion to the substrate, uniform thickness, and high purity at ambient temperature.

Another object of the present invention is to provide a method of coating a substrate which is useful in forming a coating having large thickness.

A further object of the present invention is to provide a method of coating a substrate, which makes it possible to form a coating at low electric power using a simple system.

Moreover, the object of the present invention is to provide a method of coating a substrate, which is economical and suitable to preservation of environment because a left unused coating material can be recovered easily at high recovery rate.

In addition, the object of the present invention is to provide a method of coating a substrate which is useful in forming a uniform coating on a substrate having a complicated shape.

EXPLANATION OF NUMERALS

Figure 1:
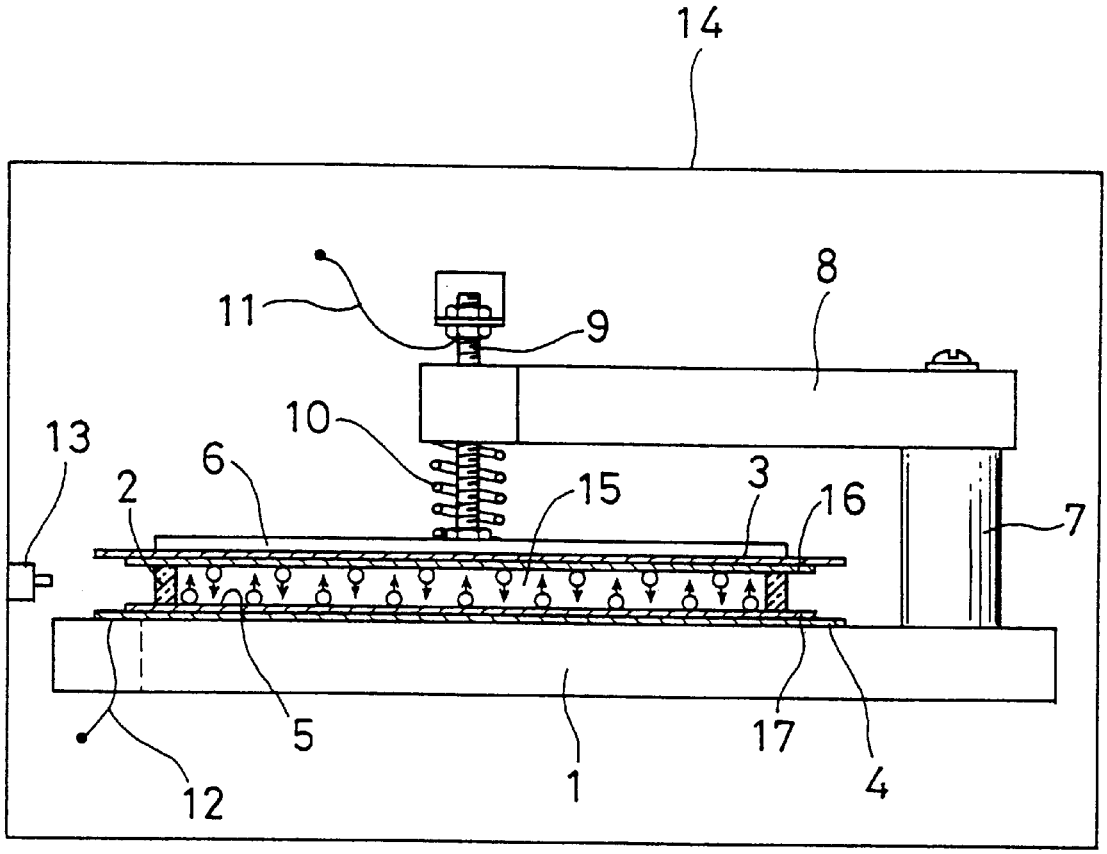
FIG. 1 is a diagrammatic sectional view of an apparatus for carrying out one embodiment of the present invention.

1:base plate
2:insulating member
3:electrode
4:electrode
5:particles
6:press plate
7:support rod
8:arm
9:connection bar
10:spring
11:lead wire
12:lead wire
13:YAG laser
14:vacuum chamber
15:enclosed space
16:substrate
17:substrate
21:electrode
22:electrode
23:insulating disk

24:press plate
25:particles
26:support stand
27:lead wire
28:lead wire
29:carbon brush
30:pulley
31:YAG laser
32:disk
33:packing
34:bushing
35:belt
36:pulley
37:vacuum chamber
38:shaft
39:shaft support bar
40:pulley
45:carbon brush
50:enclosed space
60:support column
70:substrate (inner pipe)
71:substrate (outer pipe)
101:electrode
102:electrode
103:insulating disk
104:insulating disk
105:particles
106:support stand
107:lead wire
108:lead wire
109:packing
110:packing
111:nut
112:support stand
113:packing
120:non-conductive substrate (outer pipe)
121:non-conductive substrate (inner pipe)
130:enclosed space

DESCRIPTION OF THE INVENTION

The inventor of the present invention has found that a coating can be formed on a substrate by disposing a non-conductive substrate within a space, introducing particles of a coating material within the space, the space being defined by at least a pair of electrodes and an insulating member inserted between the electrodes, and vibrating the particles by applying an ac voltage between the electrodes so as to coat the non-conductive substrate with the coating material. The present invention, therefore, provides a coating method comprising the steps of; disposing a non-conductive substrate within a space; introducing particles of a coating material within the space; the space being defined by at least a pair of electrodes and an insulating member inserted between the electrodes; and vibrating the particles by applying an ac voltage between the electrodes so as to coat the non-conductive substrate with the coating material. Preferably, the space defined by at least a pair of electrodes and the insulating member inserted between the electrodes is evacuated prior to application of the ac voltage. Preferably, when the coating substrate has a plate shape, the electrodes in pair are placed opposite each other. Preferably, when the non-conductive substrate has a cylindrical shape, the electrodes in pair are arranged concentrically so as to face each other. The said substrate may be a material selected from the group consisting of polymers (such as, for example, TEFLON, polyurethane), porcelain, ceramics (such as, for example, aluminum oxide, magnesium oxide, silicon carbide), ceramic fibers, silica (for example, glass), glass epoxy, wood (for example, hard wood), rubber (for example, hard rubber), and fibers. The coating materials may be selected from metals or metal compounds. The coating materials may include super-conductive alloys or compounds, especially such as high temperature super-conductive compounds, shape memory effect alloys, and magnetic alloys. An average particle diameter may preferably be 0.05 to 300 $\mu$m. A peak value of the ac voltage may preferably be 2 kV to 80 kV. A frequency of the ac voltage may preferably be 50 Hz to 60 MHz. The space defined by at least a pair of electrodes and the insulating member inserted between the electrodes may preferably be evacuated to $10^{-2}$ torr or less. The ac voltage may preferably be applied so as to impart a kinetic energy of $10^5$ eV or more to the particles. The insulating member may be selected from the group consisting of such as, for example, glass, polytetrafluoroethylene, polyimide, and porcelain. The non-conducting substrate may be coated at ambient temperature. The amount of particles per unit area of a coating surface on the non-conductive substrate may preferably be 0.1 to 100 mg/cm$^2$.

The present application herein incorporates the contents described in the description and/or the drawings of the Japanese Patent Application No. Heisei 10-186256, which is a prior application from which the subject application claims convention priority.

DESCRIPTION OF THE INVENTION

In the present invention, a surface of the electrode comprises a conductor or a semi-conductor. The electrode may entirely be made of the conductor or the semi-conductor, or alternatively, the electrode may have a coating of the conductor or the semi-conductor on the side facing to the other electrode.

Suitable conductive materials in the present invention may include Fe, brass, copper, aluminum, stainless steel, molybdenum, tungsten and the like. Suitable semi-conductors may include Si, Ge, non-metallic carbon and the like.

Shapes of the electrodes may include but not limited a plate shape, a cylindrical shape, a hollow cylinder shape and a columnar shape; any electrodes having more complex shapes may be used herein. Electrodes of a plate shape, a cylindrical shape, a hollow cylindrical shape and a columnar shape are especially effective to form a uniform coating on the substrate.

At least a pair of the electrodes may preferably be arranged to face opposite each other. In the present invention, a thickness of the coating may be easily controlled in a desired manner by changing the distance between the electrodes facing each other. When a voltage is applied between the electrodes, the strength of an electric field formed between the electrodes is in inverse proportion to the distance between electrodes. As a result, the energy given to the micro-particles present between the two electrodes is also in inverse proportion to the distance between electrodes. Therefore, thinner coating may be obtained by setting the distance between electrodes larger and larger and alternatively, thicker coating may be obtained by setting the distance between electrodes smaller and smaller. In order to obtain a coating with uniform thickness, at least a pair of electrodes may be disposed so as to give a constant inter electrode distance over the whole area. Generally, the distance between electrodes is so selected as to form a uniform electric field and it is preferably 0.3~3 cm.

In the present invention, the enclosed space containing the non-conductive substrate and the particles of the coating material is defined by at least a pair of electrodes and the insulating member. In the present specification, the term "enclosed" means such a sealed condition that the particles of the coating material do not run off from the space defined by at least a pair of electrodes and the insulating member but that the space can be evacuated to a predetermined pressure. The enclosed space may be formed by, for example, sandwiching a hollow shaped insulating member with at least a pair of electrodes, or alternatively by arranging a pair of electrodes to be opposite each other and sandwiching both sides with the insulating member; however, any other arrangements may be used to form the enclosed space.

The insulating member that can be suitably used in the present invention may be selected from among any materials which can keep electrical insulation between the electrodes during coating the substrate. However, materials that will not readily electrify may be preferred, since they are resistant to adhesion of micro-particles. Such materials may include glass such as quartz glass and pyrex glass, polyterrafluoroethylene, polyimide (for example, Kapton available from Du Pont Co., Ltd.), and porcelain. Among these, glass such as quartz glass and pyrex glass may be preferred from a durability viewpoint because they have thermal resistance to heat generated by discharge between the electrodes.

The non-conductive substrate is placed in the space defined by at least a pair of the electrodes and the insulating member and the particles of the coating material are introduced into the space.

There is no substantial limitation on the substrate that can be suitably used in the present invention. The substrate may be selected from any materials including inorganic materials, organic materials, and electrifiable semiconductors and insulators so far as they do not generate a gas to cause discharge. The materials of the substrate may include polymers (such as, for example, TEFLON®, polyurethane), porcelain, ceramics (such as, for example, aluminum oxide, magnesium oxide, silicon carbide), ceramic fibers, silica (such as, for example, glass), glass epoxy, wood (such as, for example, hard wood), rubber (such as, for example, hard rubber), fibers and the like.

Preferably, the non-conductive substrate may be held tightly in the evacuated space defined by at least a pair of electrodes and the insulating member by, for example, bonding the non-conductive substrate to one or both of the paired electrodes.

The coating materials that can be suitably used in the present invention may be metals including Be, B, C, Al, Si, Ti, V, Cr, Mn, Fe, Co, Ni, Cu, Ge, Rb, Y, Zr, Nb, Mo, Ru, Rh, Pd, Sn, Hf, Ta, W, Re, Os, Ir, Pb, Bi, ect.

Also the coating material that can be suitably used in the present invention may be metal compounds including stailess steel, $Cr_2N$, TiN, TiC, CoCr, CoNi, $Al_2O_3$, TaN, NiCr, SiC, TiCr, TiFe, ect.

Among these metals and metal compounds, Si, Cr, Mn, Ni, Ge, Mo, Pd, W, $Cr_2N$, CoCr, and TaN are preferred because they cause an extremely small amount of discharge and permit stable coating operation. Si can coat any substrate at high speed.

Other coating materials that can be suitably used in the present invention may include super-conductive alloys or compounds such as NbTi, NbSn, $V_3Ga$, NbAl, and $NbSi_2$, high temperature super-conductive compounds such as those based on Y (such as, for example, $YBaCu_3O_x$ etc.), Bi, La, Tl, Hg and the like, and magnetic alloys such as Fe—Cr—Co, Nd—Fe—B, $SmCO_5$ and the like.

Preferably, the particles of the coating material may be micro-particles of which the particle size may be 0.05 to 300 μm, preferably 0.1 to 200 μm, more preferably 1 to 50 μm. If the particle size of the micro-particles is smaller than 0.05 μm, the micro-particles may form aggregates and occasionally fail to vibrate even if a voltage is applied between the electrodes. If the particle size of the micro-particles is larger than 300 μm, no coating may be formed because the vibration speed of the micro-particles becomes too low.

The particles of the coating material may be spheres, lumps teardrops, flakes, porous and irregular, irregular particles, ect.

The amount of the particles of the coating material depends on the density of the particles and usually ranges from 0.1 to 100 mg/cm$^2$, preferably from 1 to 40 mg/cm$^2$, more preferably from 5 to 30 mg/cm$^2$. If the amount of the particles is less than 0.1 mg/cm$^2$, the coating speed decreases. If the amount of the particles is more than 50 mg/cm$^2$, the electrodes may be short-circuited by discharge.

Preferably, the enclosed space containing the non-conducting substrate and the particles of the coating material may be evacuated after it is defined by at least a pair of electrodes and the insulating material. Methods for evacuation may include reducing the pressure in the enclosed space with a vacuum pump directly, or by first forming the enclosed space in a vacuum chamber and then reducing its pressure with a vacuum pump. The degree of vacuum in the enclosed space should not be more than $10^{-2}$ torr, and preferably not more than $10^{-5}$ torr. If the degree of vacuum is such lower that the pressure is higher than $10^{-2}$ torr, the electrodes may be short-circuited due to discharge. Coating of the non-conductive substrate with the coating material may be possible even if the pressure in the enclosed space which is defined by at least a pair of electrodes and the insulating member and which contains the non-conductive substrate and the coating material is not evacuated.

After the evacuation step an ac voltage is applied between the electrodes to form an electric field in the evacuated space defined by at least a pair of electrodes and the insulating member. The electric field should be strong enough to impart electric charges to the particles of the coating material between the electrodes so that the particles undergo a certain vibration with respect to the electrodes. In order that the particles of the coating material undergo a predetermined vibration, it is usually preferred to apply an ac voltage having a peak voltage of 2 kV to 80 kV between the electrodes.

There is no substantial limitation on the frequency of the ac voltage and it may be selected from low to ultra-high frequency ranges. However, frequencies between 50 Hz and 60 MHz are usually preferred.

Preferably, the intensity of the electric field is increased gradually. That is, as the strength of the electric field is increased gradually, the vibrating particles are accelerated to repeat the vibration between the electrodes until they are embedded into and deposited on the substrate so as to form a uniform continuous coating. Here, applying a high voltage between the electrodes suddenly to form an intense electric field is not preferred, because adsorbed gases on the surfaces of the coating material and the substrate are released suddenly to cause a discharge between the electrodes. Therefore, the electric field in the evacuated space is preferably increased gradually to a predetermined strength so as not to cause a discharge between the electrodes. Typically, it is preferred to increase the strength of the electric field at a rate of 0.1–0.5 kV/cm·min in order to suppress the sudden release of gases.

The final strength of the electric field suitably ranges from 3 to 80 kV/cm. A strength higher than 80 kV/cm tends to cause a discharge between the electrodes, which increases the chance of short circuiting and makes it difficult to coat the substrate with consistently vibrating particles. A preferred range is from 5 to 40 kV/cm, and a more preferred range is from 10 to 40 kV/cm.

In the present invention, the particles of different kinds of substances (such as, for example, metals, metal compounds, super-conductive alloys and compounds including high temperature super-conductive compounds, shape-memory effect alloys, magnetic alloys) may be simultaneously charged into the enclosed space as coating materials, thereby forming coatings of novel compounds such as a coating comprising a mixture of different kinds of materials or a coating of an alloy on the substrate.

Further in the present invention, it is possible to form a complex hybrid-type coating in which different kinds of substances are placed one on another by changing the kinds of the coating substances and repeating the above operation for coating the substrate.

In the present invention, the substrate may be coated at ambient temperature in a desired manner, but the coating may usually be carried out in a temperature range of 0–50° C.

The coating obtained by the method of the present invention exhibits excellent adhesion to the substrate.

The practical embodiment of the present invention will be explained in detail with referring to the drawings attached.

FIG. 1 shows a diagrammatic cross section of a substrate coating apparatus used for practicing the method of the present invention for coating the substrate.

As shown in FIG. 1, the substrate coating apparatus comprises a vacuum chamber 14, disk-shaped electrode 3 disposed in the vacuum chamber 14, a disk-shaped electrode 4, and a ring shaped insulating member 2. The electrode 4 is placed on a base plate 1 made of an insulating material, and the electrode 3 is disposed parallel to the electrode 4, with the insulating member 2 held between the electrodes 3 and the 4. A spring 10 made of a conductor is disposed resiliently about a connection bar 9 and exerts a predetermined pressure on the electrode 3 through a press plate 6 made of a conductive material so that an enclosed space 15 is defined by the electrode 3, the electrode 4, and the insulating member 2. A support rod 7 is secured to the base plate 1 and an arm 8 is screwed to an end of the support rod 7. The connection bar 9 is movably supported by the arm 8 and one end of the connection bar 9 is screwed to the press plate 6.

The electrodes 3 and 4 are each connected to an ac high voltage supply (not shown) outside the vacuum chamber 14 by lead wires 11 and 12 via. a feed through connector. A vacuum pump (not shown) is connected to the vacuum chamber 14.

In order to observe the behaviour of the coating substance during coating the electrodes 3 and 4, a YAG laser 13 is disposed so as to allow the issued laser light to pass between the electrodes 3 and 4.

When coating the substrate, non-conductive substrates 16, 17 are first bonded to the electrodes 3, 4, respectively, and then a predetermined amount of the micro-particles 5 of the coating material is distributed on the electrode 4 in a desired manner.

Next, the enclosed space 15 is defined by the electrode 3, electrode 4, and the insulating member 2 by placing the ring shaped insulating member 2 on the electrode 4, placing the electrode 3 on the insulating member 2, and placing the press plate 6 on the electrode 3 while pressing the press plate 6 with the spring 10.

After that, the vacuum chamber 14 is evacuated to $10^{-4}$ torr or less by the vacuum pump.

Next, a predetermined voltage is applied to the electrodes 3 and 4 from the ac high voltage supply (not shown). The voltage is elevated at a predetermined rate to increase the strength of the electric field between the electrodes 3 and 4. As a result, when an electric field not less than 2.5 kV/cm is generated between the electrodes, the micro-particles 5 of the coating material contained in the enclosed space 15 typically start to vibrate between the electrodes 3 and 4. As the strength of the electric field is increased, the micro-particles 5 of the coating material in the enclosed space 15 vibrate more vigorously. The micro-particles 5 of the coating material impinge strongly on the surfaces of the non-conductive substrates 16 and 17, and are embedded into those surfaces and deposited thereon to form a coating. After reaching a predetermined strength of electric field, the intensity of the electric field is held for a predetermined duration of time. As a result, a coating of the coating material is formed on the non-conductive substrates 16 and 17.

Figure 2:
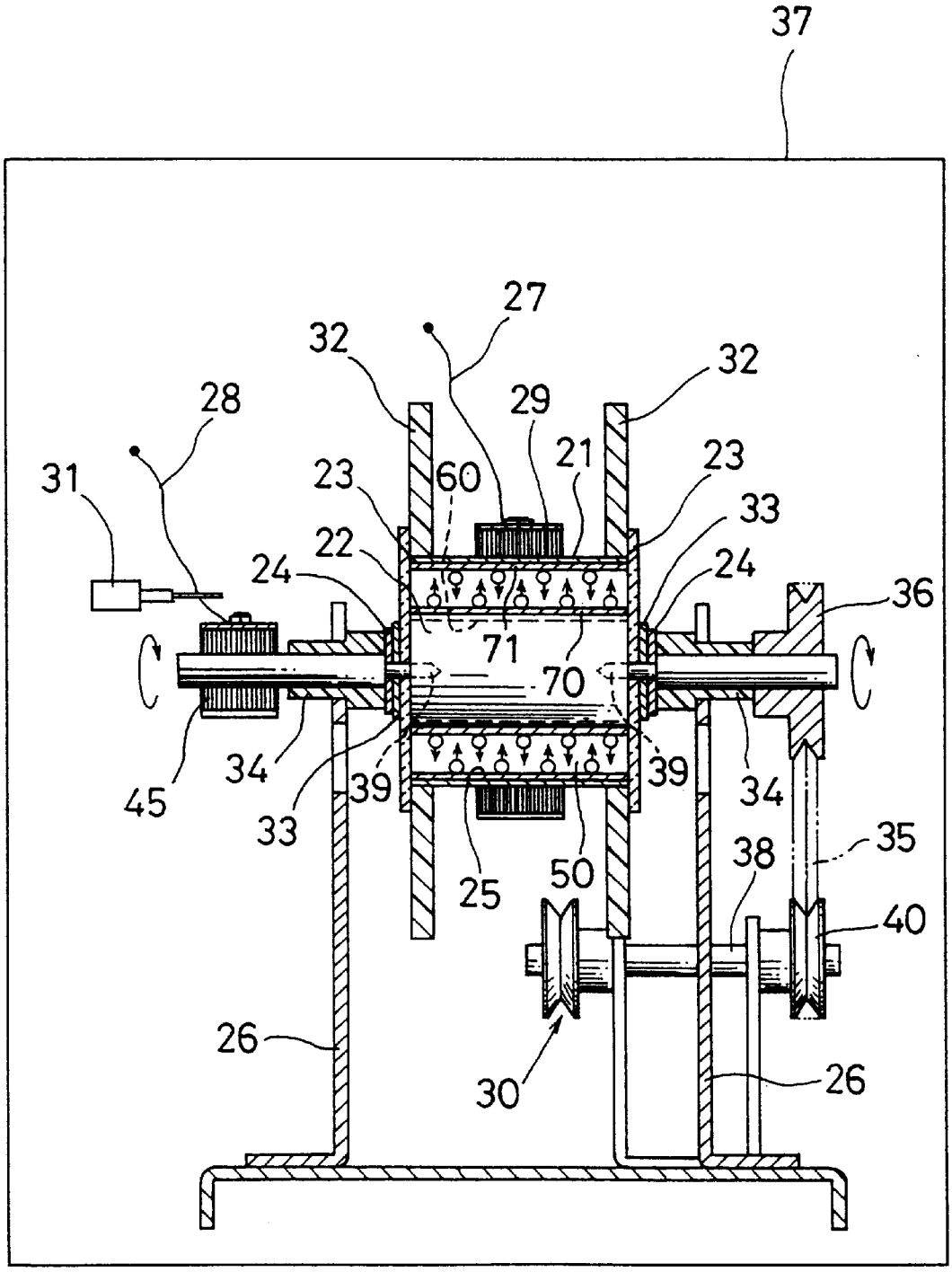
FIG. 2 is a diagrammatic sectional view of an apparatus for carrying out a second embodiment of the present invention.
Figure 3:
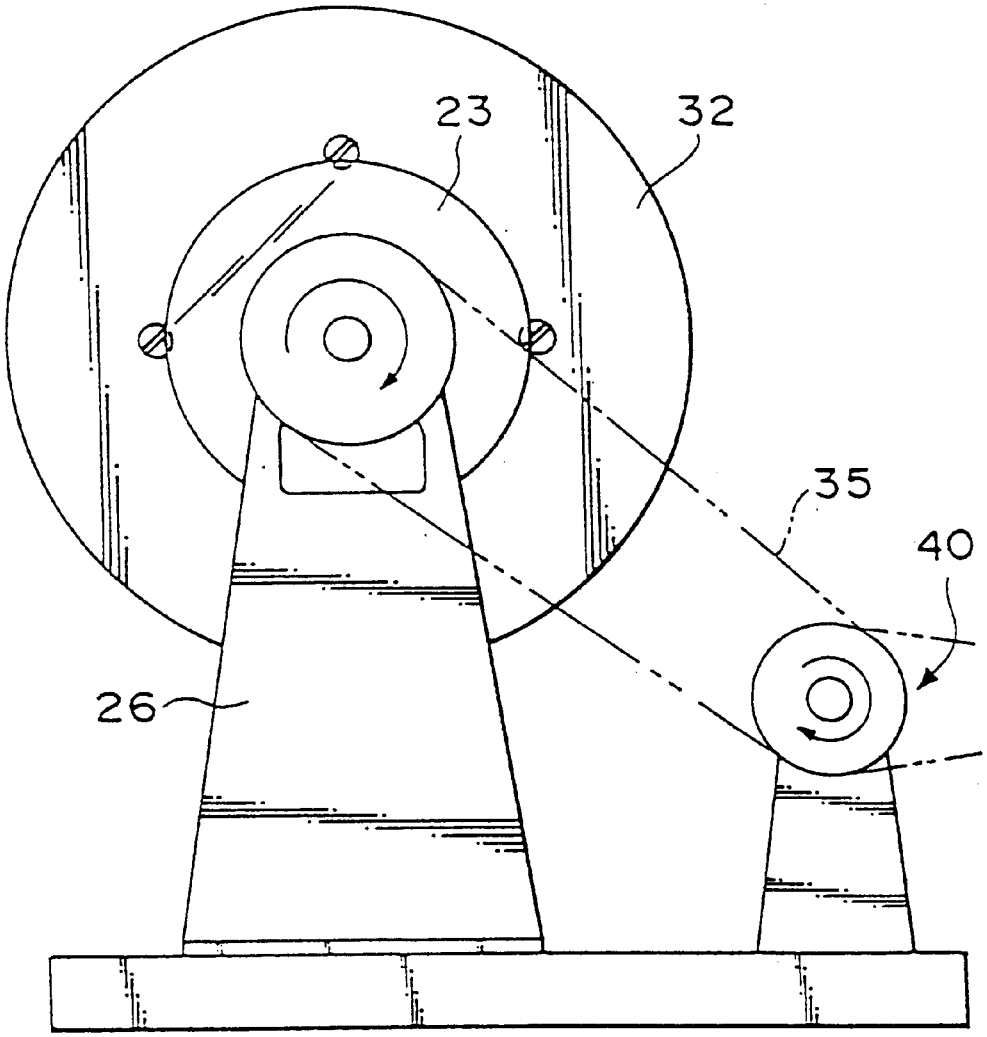
FIG. 3 is a diagrammatic side view of an apparatus for carrying out a third embodiment of the present invention.

FIG. 2 shows a diagrammatic cross section of another embodiment of a substrate coating apparatus used to practice the coating method of the present invention, and FIG. 3 shows a diagrammatic side view thereof.

As shown in FIGS. 2 and 3, the substrate coating apparatus comprises a vacuum chamber 37 which contains a hollow cylindrical electrode 21, a cylindrical electrode 22, and a pair of insulating disks 23 made of an insulating material. A support column 60 is inserted in the cylindrical electrode 22 such that it contacts the electrode 22. The lateral ends of the hollow cylindrical electrode 21 engaged disks 32. The electrode 22 is disposed inside the hollow cylindrical electrode 21. The insulating disks 23 are disposed outside the paired disks 32 to retain the electrodes 21 and 22 therebetween. Shaft support bars 39 each exert a predetermined pressure on the paired insulating disks 23 from outside through a packing 33 and a press plate 24. The shaft support bars 39 are so constructed as to be screwed in holes formed at the center of the paired insulating disks 23 and at both sides of the support cylinder 60 along its center axis. The shaft support bars 39 are supported by high voltage insulating bushings 34. One of the bushings 34 is coupled to a pulley 36. The paired bushings 34 are held by support stands 26.

A pulley 40 is disposed to allow a belt 35 to stretch between the pulleys 36 and 40. The pulley 40 is coupled via a shaft 38 to a pulley 30 so that they can rotate synchronously. The pulley 30 is coupled to a drive motor (not shown) through a belt (not shown).

A lead wire 27 is connected to the electrode 21 through a carbon brush 29, and a lead wire 28 is connected to the electrode 22 through a carbon brush 45. The lead wires 27 and 28 are each connected to an ac high voltage supply (not shown) outside the vacuum chamber 37 via a feed through connector. A vacuum chamber (not shown) is connected to the vacuum chamber 37.

In order to observe the behaviour of the coating substance during coating the electrodes 21 and 22, a YAG laser 31 is disposed so as to allow the issued laser light to pass between the electrodes 21 and 22.

When coating the substrate by the coating apparatus having the above construction, a predetermined amount of the micro-particles 25 of the coating material is first distributed on a lower inner surface of the hollow cylindrical electrode 21 in a desired manner.

After the support column 60 having tap holes is inserted into the cylindrical electrode 22, the non-conductive substrate 71 (outer pipe) and the non-conductive substrate 70 (inner pipe) are inserted between the electrodes 21 and 22. The electrode 21, the non-conductive substrate 71 (outer pipe), the non-conductive substrate 70 (inner pipe), and the electrodes 22 are held between the insulating disks 23.

After disposing press plates 24, disks 32 and packings 33 outside the insulating disks 23, the shaft support bars 39 are screwed into the tap holes at the center of the support cylinder 60 to exert pressures on the press plate 24.

After inserting the thus disposed shaft support bars 39 into the bushings 34, the entire apparatus as assembled above is installed on the support stand 26. Next, the carbon brushes 29 and 45 are connected to the electrodes 21 and 22, respectively.

Thereafter, the vacuum chamber 37 is evacuated to $10^{-4}$ torr or less.

Next, the motor (not shown) is actuated to rotate the electrodes 21 and 22, the non-conductive substrate 71 (outer pipe), the non-conductive substrate 70 (inner pipe), and the insulating disks 23 at a speed of 10 to 25 rpm through the pulley 30, the belt (not shown), the pulley 40, the belt 35, the pulley 36 and the bushings 34. Simultaneously, a predetermined voltage from the ac high voltage supply (not shown) is applied to the electrodes 21 and 22. In addition, the voltage is elevated at a predetermined rate to increase the strength of the electric field between the electrodes 21 and 22. As a result, when an electric field not less than 2.5 kV/cm is generated between the electrodes, the micro-particles 5 of the coating material contained in the enclosed space 15 start to vibrate between an inner wall surface of the electrode 21 and a wall surface of the electrode 22. As the electric field is increased, the micro-particles 25 of the coating material in the enclosed space 50 vibrate more vigorously. After a predetermined strength of the electric field is reached, it is held for a predetermined duration of time. As a result, the micro-particles of the coating material are embedded into the inner wall surface of the non-conductive substrate 71 (outer pipe) and the outer wall surface the non-conductive substrate 70 (inner pipe) and depositted thereon to form a coating. Here, it may possible to apply coating without rotating the electrodes 21 and 22, the non-conductive substrate 71 (outer pipe), the non-conductive substrate 70 (inner pipe), and the insulating disks 23.

Figure 4:
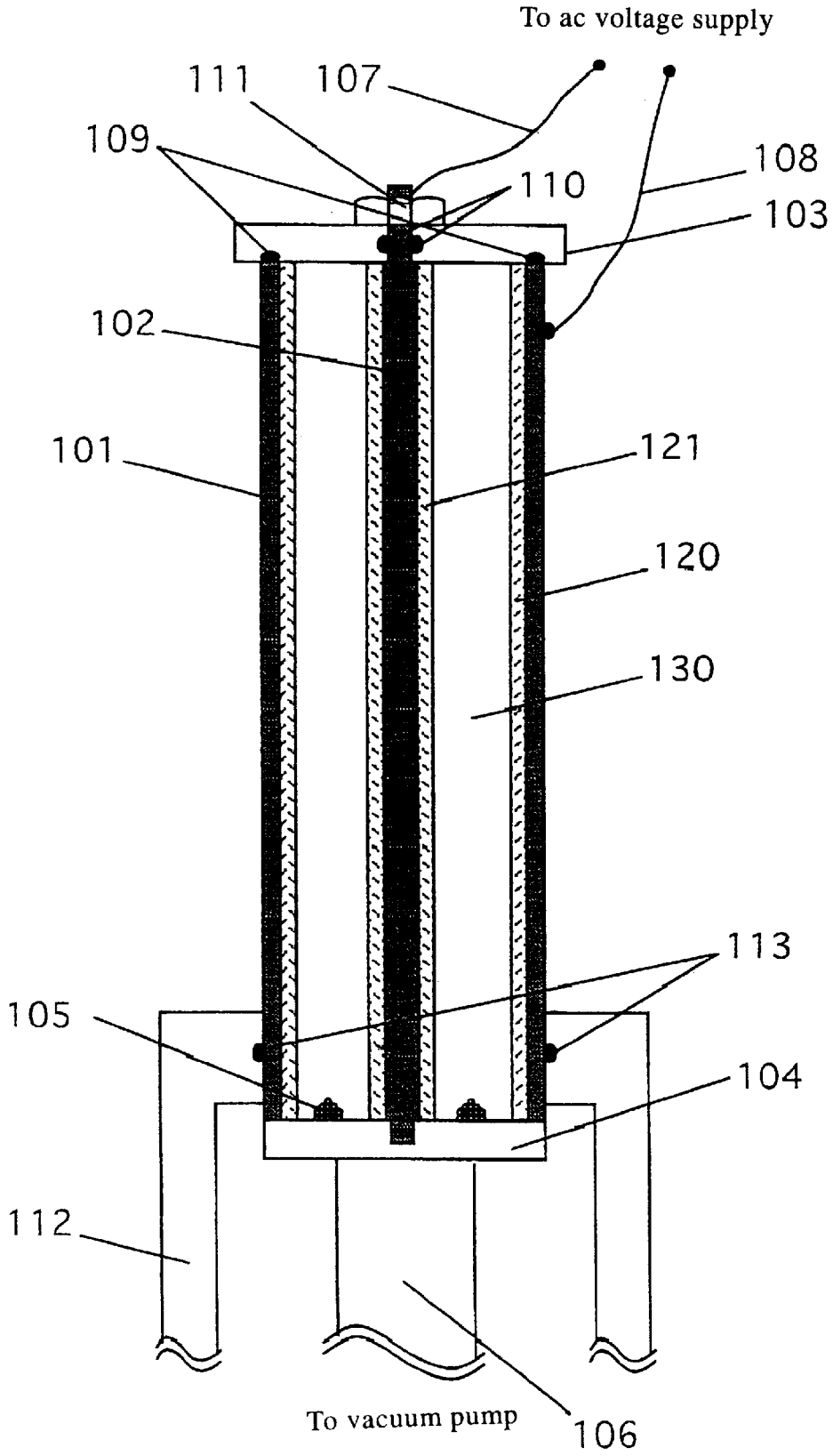
FIG. 4 is a diagrammatic cross sectional view of an apparatus for carrying out a fourth embodiment of the present invention.

FIG. 4 shows another embodiment of a substrate coating apparatus for practicing the substrate coating method of the present invention.

As shown in FIG. 4, a substrate coating apparatus comprises a hollow cylindrical electrode 101, a columnar electrode 102, and a pair of insulating disks 103, 104 made of an insulating material. One of the insulating disks 103 has a through-hole and a packing recess formed at the center thereof, as well as a packing recess formed at a lower side thereof, and the other insulating disk 104 has a concave portion at the center thereof. Protrusions are formed at opposite ends of the columnar electrode 102, and the lower protrusion is sized to be inserted into the concave portion of the insulating disk 104. A tap screw is formed at a portion of the upper protrusion so that it can be inserted into the through hole formed at the center of the insulating disk 103. The paired insulating disks 103 and 104 are assembled to hold the upper and lower ends of the hollow cylindrical electrode 101 and the columnar electrode 102 therebetween, and also to receive the protrusion of the columnar electrode 102 into the concave portion of the insulating disk 104. The insulating disk 103 is also fastened by a nut 111 through packings 109 and 110 so that the electrodes 101 and 102 and the pair of the insulating disks 103 and 104 define an enclosed space 130. The electrodes 101 and 102 and the pair of insulating disks 103 and 104, which define the enclosed space 130, are integrally installed on a support stand 112 via a packing 113 and are held by a support stand 106 in contact with the insulating disk 104.

A lead wire 107 is connected to the nut 111, and a lead wire 108 is connected to the electrode 101. The lead wires 107 and 108 are each connected to an ac high voltage supply (not shown) via a feedthrough connector. A vacuum pump (not shown) is connected to the enclosed space.

When coating a substrate by the substrate coating apparatus having the above construction, the insulating disk 104 is first placed on the support stand 106, and a predetermined amount of the micro-particles 105 of the coating material is distributed on the upper surface of the insulating disk 104 in a desired manner. Next, the protrusion of the columnar electrode 102 is inserted into the concave portion of the insulating disk 104. Subsequently, the non-conductive substrate 121 (inner pipe), the non-conducting substrate 120 (outer pipe) and the hollow cylindrical electrode 101 are placed on the insulating circular plate 104 such that they are concentric with the columnar electrode 102.

After the packing 109 is placed on the hollow cylindrical electrode 101 and the packing 110 is seated into the packing recess formed at the center of the insulating disk 103, the insulating disk 103 is placed to receive the columnar electrode 102. Then, the nut 111 is screwed in from above the insulating circular plate 103 to define an enclosed space.

Thereafter, the entire apparatus as assembled above is held on the support stand 112 through the packing 113 at the lower outer periphery of the hollow cylindrical electrode 101.

Subsequently, the lead wires 107 and 108 are connected to the nut 111 and the electrode 101, respectively.

Thereafter, the enclosed space 130 is evacuated to $10^{-4}$ torr or less by the vacuum pump.

Next, a predetermined voltage is applied to the electrodes 101 and 102 from the ac high voltage supply (not shown). The voltage is elevated at a predetermined rate so as to increase the strength of the electric field between the electrodes 101 and 102. As a result, when an electric field not less than 3.0 kV/cm is generated between the electrodes, the micro-particles 105 of the coating material contained in the enclosed space 130 start to vibrate between an inner wall surface of the electrode 101 and a wall surface of the electrode 102. As the electric field is increased, the micro-particles 105 of the coating material in the enclosed space 130 vibrate more vigorously. After a predetermined strength of the electric field is reached, it is held for a predetermined duration of time. As a result, the micro-particles of the coating material are embedded into the inner wall surface of the non-conductive substrate 120 (outer pipe) and the outer wall surface the nonconductive substrate 121 (inner pipe) and deposited thereon to form a coating. Here, an extremely thin wire may be used as the electrode 102.

It is deemed that the substrate coating method of the present invention is based on the following principle;

When an ac current is applied to a space (evacuated) which is defined by at least a pair of electrodes and the insulating member and within which the non-conductive substrate is placed and the particles of the coating material are contained, the powder particles are charged to the same polarity as the electrode which they contact due to triboelectricity, and then are repelled by the electrode to move toward the opposite electrode. When the applied voltage is low, only small particles can move by overcoming the gravity since the quantity of electrity on the powder is limited. However, larger particles begin to move as the applied voltage is elevated. When the powder particles impinge on the opposite electrode, the inverse charge is imparted thereto so as to cause the powder particles to move toward the electrode which they initially contacted. The above vibration phenomenon is usually observed when the strength of the electric field is 2.5 kV/cm or more. As the applied voltage is elevated, the amount of electricity on the particles is increased and the acceleration energy is increased; when the electric field is about 5 kV/cm, the particles start to be embedded in the substrate and deposited thereon to form a coating. When the applied voltage is further elevated to increase the electric field, the deposition rate of the powder particles is increased. Usually, when the strength of the electric field is increased to 80 kV/cm or more, the surface electric field reaches a discharge value and the electrodes are short-circuited so that the powder particles cannot be accelerated any longer.

Usually, the powder particles accelerated by the high energy imparted in the electric field of 3–30 kV are gradually deposited and layered on the substrate to cover the surface of the substrate by repeating the impingement on the surfaces of the opposed electrodes.

In evaporation, sputtering and electroplating processes, the particles of a coating material are deposited by impingement on a substrate with average kinetic energies of a few eV, several tens of eV and several hundred eV, respectively. In contrast, in the method of the present invention, the particles of a coating material can be deposited on a substrate by impinging on the substrate with a kinetic energy of at least $10^5$ eV.

For example, particles of a coating material having a particle diameter of 10 $\mu$m can be deposited on a substrate by impinging on the substrate with a kinetic energy of at least 200 keV in an electric field of 20 kV/cm. As a result, a coating having excellent adhesion to the substrate can be obtained.

The present invention will be explained in more detail with reference to the following non-limiting working examples.

EXAMPLE 1

An $Al_2O_3$ plate was coated with Cr using the substrate coating apparatus shown in FIG. 1 at an ambient temperature.

The coating material used was 50 mg of Cr with an average particle diameter of 7 $\mu$m. Aluminum oxide plates of thickness 1.0 mm with 40 mm×40 mm area were used as coating substrates. Brass plates of thickness 1 mm with 40 mm×40 mm area were used as electrode plates for generating an ac electric field. One brass plate, one aluminum oxide plate, and a ring of pyrex glass as the insulating member were placed in this order from the bottom, and Cr 50 mg was distributed. Next, the other aluminum oxide plate and the other brass plate were overlaid on the glass ring and were held together by a compressive spring so that the upper and lower electrodes became parallel to each other. Thereafter, a vacuum chamber was evacuated to $10^{-6}$ torr by a molecular pump to form an enclosed space. Then, an ac voltage of 3.0 kV was applied between the parallel brass electrodes; the voltage increase rate was 200 V/min (200 V/cm/min). When the strength of the electric field reached 3.0 kV/cm, the micro-particles of Cr started to vibrate. The vibration of the Cr mirco-particles was confirmed by monitoring the laser light from a YAG laser 31 that transmitted the glass ring to illuminate the Cr micro-particles, from which it was scattered.

Figure 5:
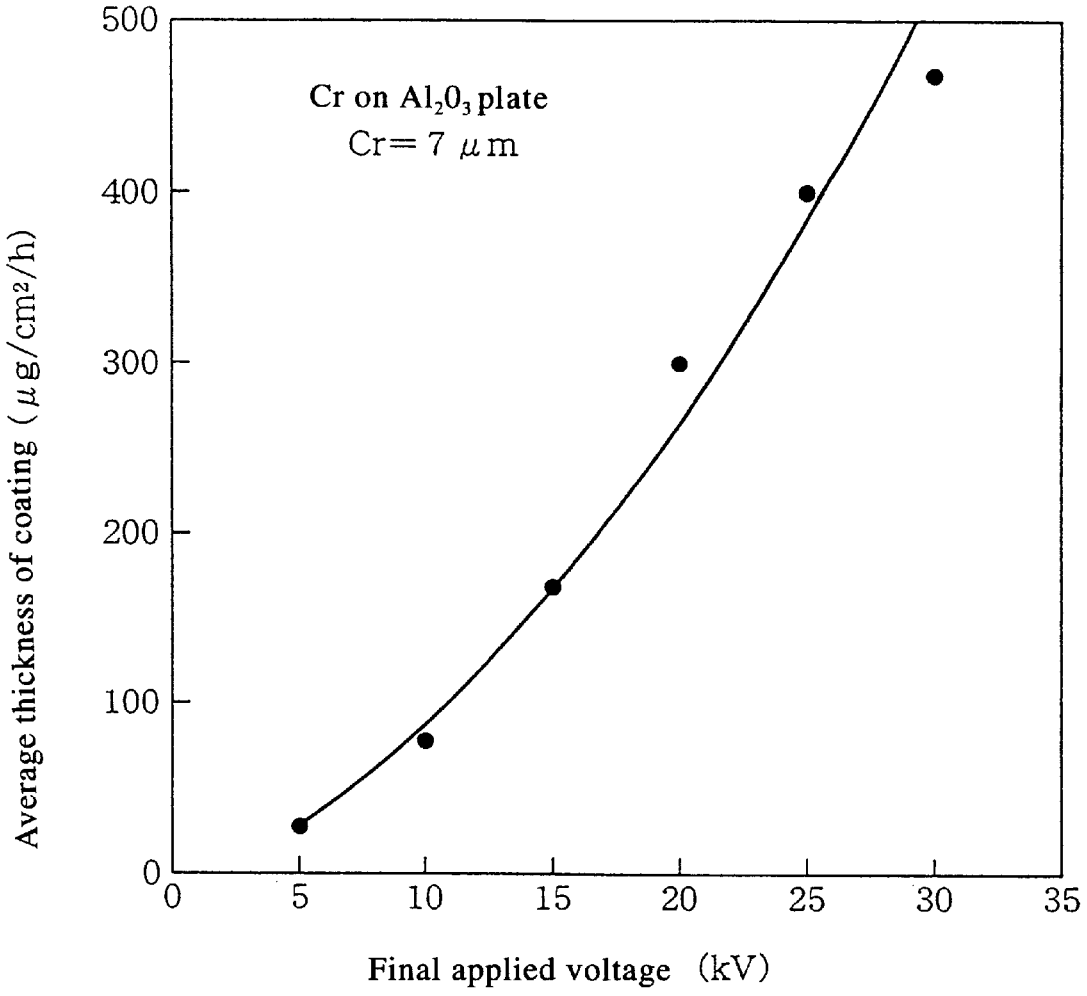
FIG. 5 is a graph showing the relationship between final applied voltage and the average amount of Cr coatings in Example 1.

The ac voltage of 3.0 kV was kept as the final applied voltage for one hour. Then, dried air was introduced into the vacuum chamber to return the pressure in the vacuum chamber to 1 atmospheric pressure, and the upper and lower aluminum oxide plates and the insulating member were taken out. The average thickness of the coatings formed on both aluminum oxide plates were measured with an analytical direct reading digital balance. In the same manner, additional coatings were formed by changing the final applied voltage to 40 kV (corresponding to a field intensity of $4.0\times10^4$ V/cm), and the average thickness of the formed Cr coatings were measured with the analytical direct reading digital balance. The obtained results of measurement are shown in FIG. 5. In FIG. 5, the horizontal axis denotes the final applied voltage between positive electrode and ground electrode, and the vertical axis denotes the average thickness of the coating in terms of the amount of coating per hour per unit area ($\mu$g/cm2/h).

The thickness distribution of the coatings formed on the aluminum oxide plates was measured with a thickness meter of MINITEST 3001 model and found to be within ±5%. Therefore, it was proved that the present invention could provide sufficient uniform coating.

EXAMPLE 2

The procedure described in the Example 1 was repeated except for using 50 mg of Si micro-particles having an average particle size 325 mesh as the coating material.

Figure 6:
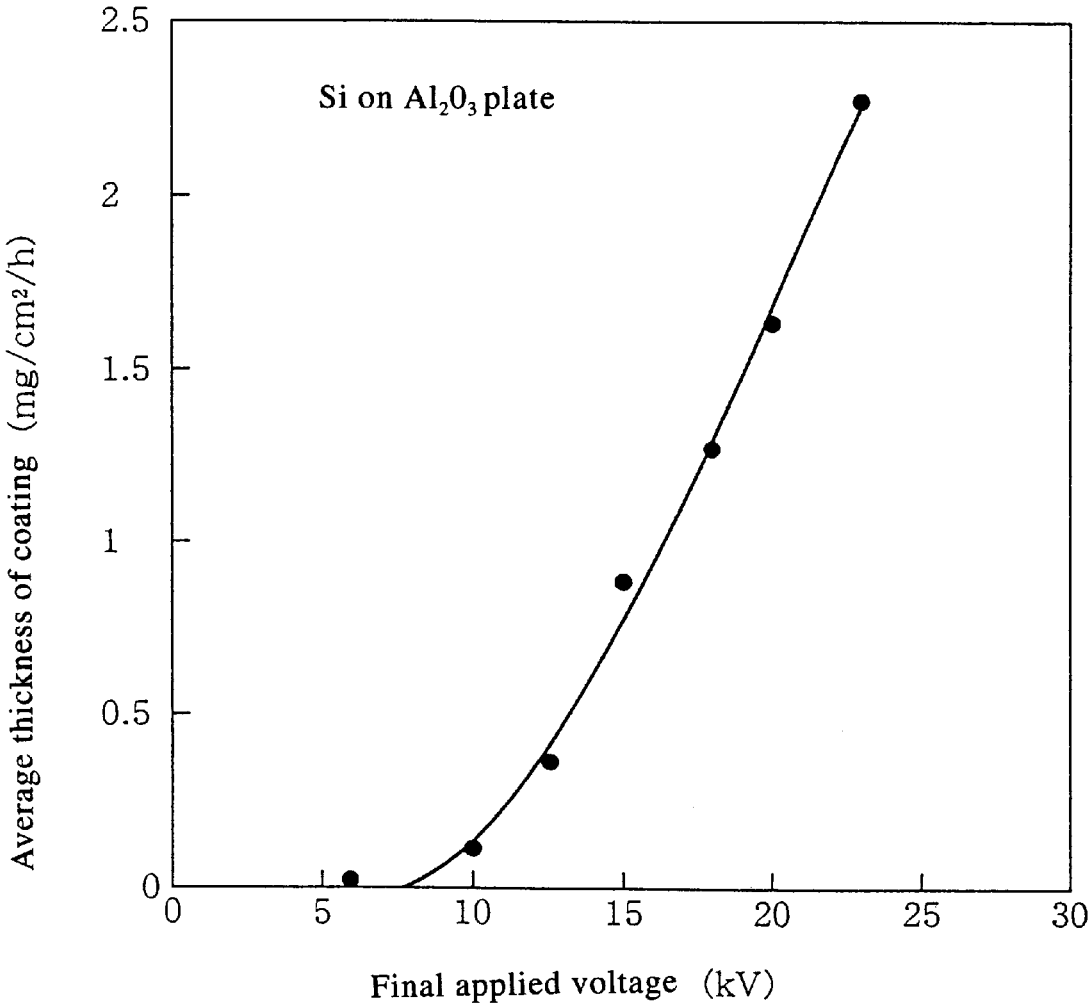
FIG. 6 is a graph showing the relationship between final applied voltage and the average amount of Si coatings in Example 2.

Results of an examination of the relation between the measured thickness of the coatings formed on $Al_2O_3$ plates and the final applied voltage are shown in FIG. 6. The average thickness of the coatings was measured with the analytical direct reading digital balance. The thickness distribution of the coatings formed on the $Al_2O_3$ plates was measured with a thickness meter of MINITEST 3001 model and found to be within ±5%. Therefore, it was proved that the present invention could provide sufficient uniform coating.

EXAMPLE 3

Bulk of oxide high temperature super-conductor $YBaCu_3O_x$ which was proved to have zero resistance and diamagnetism (Meissner effect) at the liquid nitrogen temperature was ground to micro-particles having an average particle size of 60 $\mu$m. The procedure described in the Example 1 was repeated except for using 50 mg of the above micro-particles.

Figure 7:
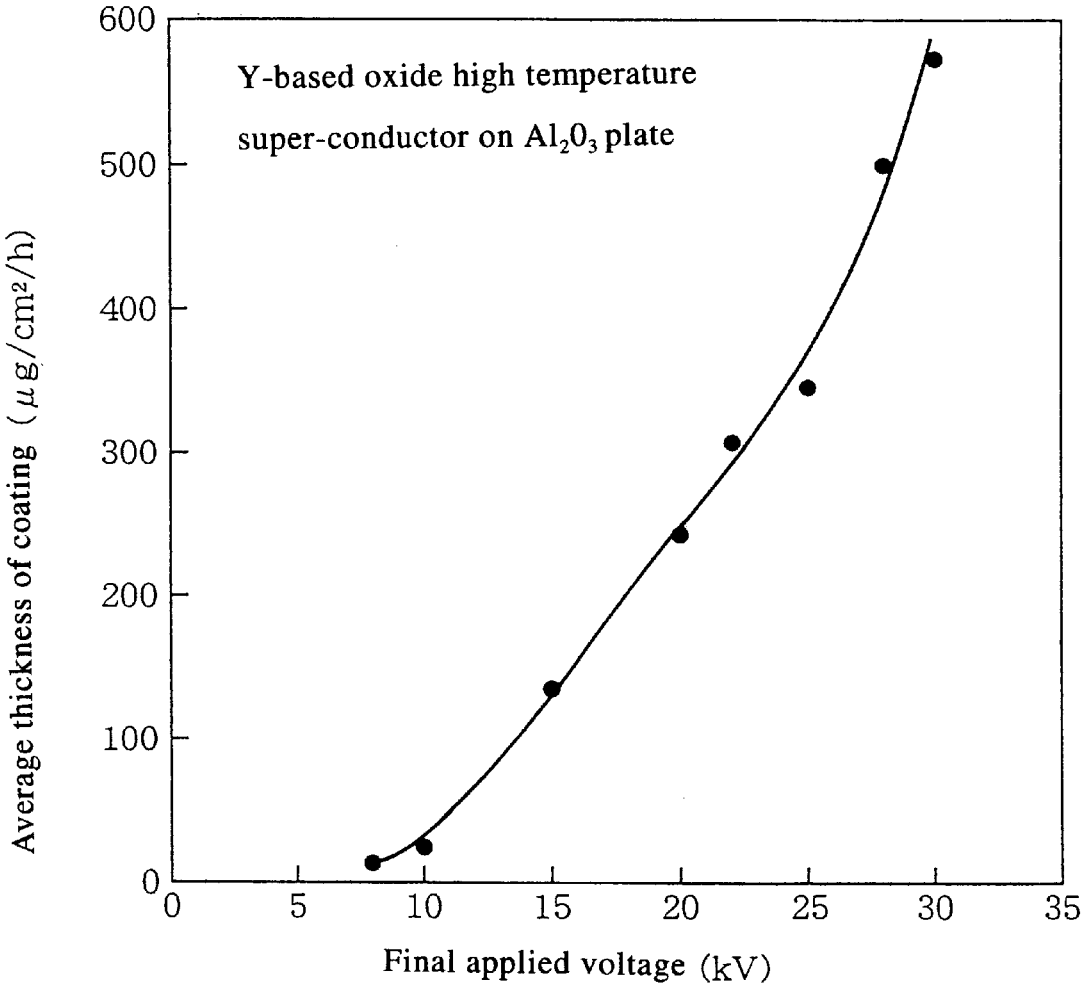
FIG. 7 is a graph showing the relationship between final applied voltage and the average amount of $YBaCuO_x$ coatings in Example 3.

Results of an examination of the relation between the measured thickness of the coatings formed on $Al_2O_3$ plates and the final applied voltage are shown in FIG. 7. The average thickness of the coatings was measured with the analytical direct reading digital balance. The thickness distribution of the coatings formed on the $Al_2O_3$ plates was measured with a thickness meter of MINITEST 3001 model and found to be within ±5%. Therefore, it was proved that the present invention could provide sufficient uniform coating.

In addition, the resistance of coatings was measured at various temperatures by the four (4) terminal resistance method, and the electric resistance of the coatings was zero at the liquid nitrogen temperature.

EXAMPLE 4

A hollow pipe made of $Al_2O_3$ and an aluminum oxide cylinder were coated with Cr using the substrate coating apparatus shown in FIGS. 2 and 3 at ambient temperature.

That is, within a brass hollow pipe electrode 21 having an outer diameter of 56 mm, an inner diameter of 50 mm, and a length of 50 mm, an aluminum oxide hollow pipe (outer pipe 71) having an outer diameter of 36 mm, an inner diameter of 30 mm, and a length of 50 mm was inserted. Cr micro-particles (200 mg) having an average particle diameter of 7 $\mu$m were uniformly distributed near the lower center portion. Within a brass hollow pipe electrode 22 having a diameter of 30 mm and a length of 50 mm, an aluminum oxide hollow pipe (inner pipe 70) having an outer diameter of 26 mm, an inner diameter of 20 mm, and a length of 50 mm was inserted, and then a support column 60 having tap holes of 3 mm Φ formed at the center thereof was inserted into the brass cylinder electrode 22. Then, the electrode 21, the outer pipe 71, the inner pipe 70 and the electrode 22 were held between pyrex glass disks used as insulating disks 23.

After an aluminum plate of 30 mm in diameter which was used as a press plate 24, an acrylic plate of 13 cm in diameter and 5 mm in thickness which was used as a disk 32, and a packing 33 made of silicone were disposed outside the insulating disks 23, shaft support bars 39 made of SUS-304 were screwed into each of the tap holes of 3 mm Φ at the center of the support column 60 to exert pressures of 0.8 kg/cm$^2$ on the press plate 24.

Furthermore, the shaft support bars 39 were inserted into a bushing 34 made of TEFLON®, and the thus assembled apparatus was installed on a support stand 26. Next, carbon brushes 29 and 45 were connected to the electrodes 21 and 22, respectively.

Then, the vacuum chamber 37 was evacuated to $10^{-6}$ torr with a molecular pump to define an enclosed space 50.

Then, a motor was actuated to rotate the electrode 21, the outer pipe 71, the inner pipe 70, the electrode 22, the insulating disks 23 and the disks 32 at a speed of 10 to 25 rpm, and an ac voltage of 1 kV was applied between the hollow brass electrode 21 and the hollow brass electrode 22 which were disposed parallel to each other. The applied voltage was elevated to 2.5 kV at a rate of 200 V/min. When the strength of the electric field reached 2.5 kV/cm, the Cr micro-particles started to vibrate. The vibration of the Cr mirco-particles was confirmed by monitoring the laser light from a YAG laser 31 that transmitted the glass ring to illuminate the Cr micro-particles, from which it was scattered.

The applied voltage was further elevated to 35 kV, and when the strength of the electric field reached 35 kV/cm, that voltage was kept for one hour as the final applied voltage.

Then, dried air was introduced into the chamber to return the inside of the vacuum chamber 37 to 1 atmospheric pressure, and the outer pipe 71 and inner pipe 70 were taken out. The average thickness of the coatings formed on an inner wall surface of the outer pope 71 and an outer wall surface of the inner pipe 70 were measured with an analytical direct reading digital balance. The average thickness of the Cr coating on the inner wall surface of the outer pipe 71 was 0.80 mg/cm$^2$ (1.1 $\mu$m), and the average thickness of the Cr coating on the outer wall surface of the inner pipe 70 was 0.55 mg/cm$^2$ (0.76 $\mu$m). The thickness distribution of the coatings was within ±5% on both the inner wall surface of the outer pipe 71 and the outer wall surface of the inner pipe 70; therefore, it was proved that the present invention could provide sufficient uniform coating.

In the same manner, additional coatings were formed by changing the final applied voltage to 40 kV (corresponding to $4.0\times10^4$ V/cm), and the average thickness of the formed Cr coating was measured with the analytical direct reading digital balance.

Figure 8:
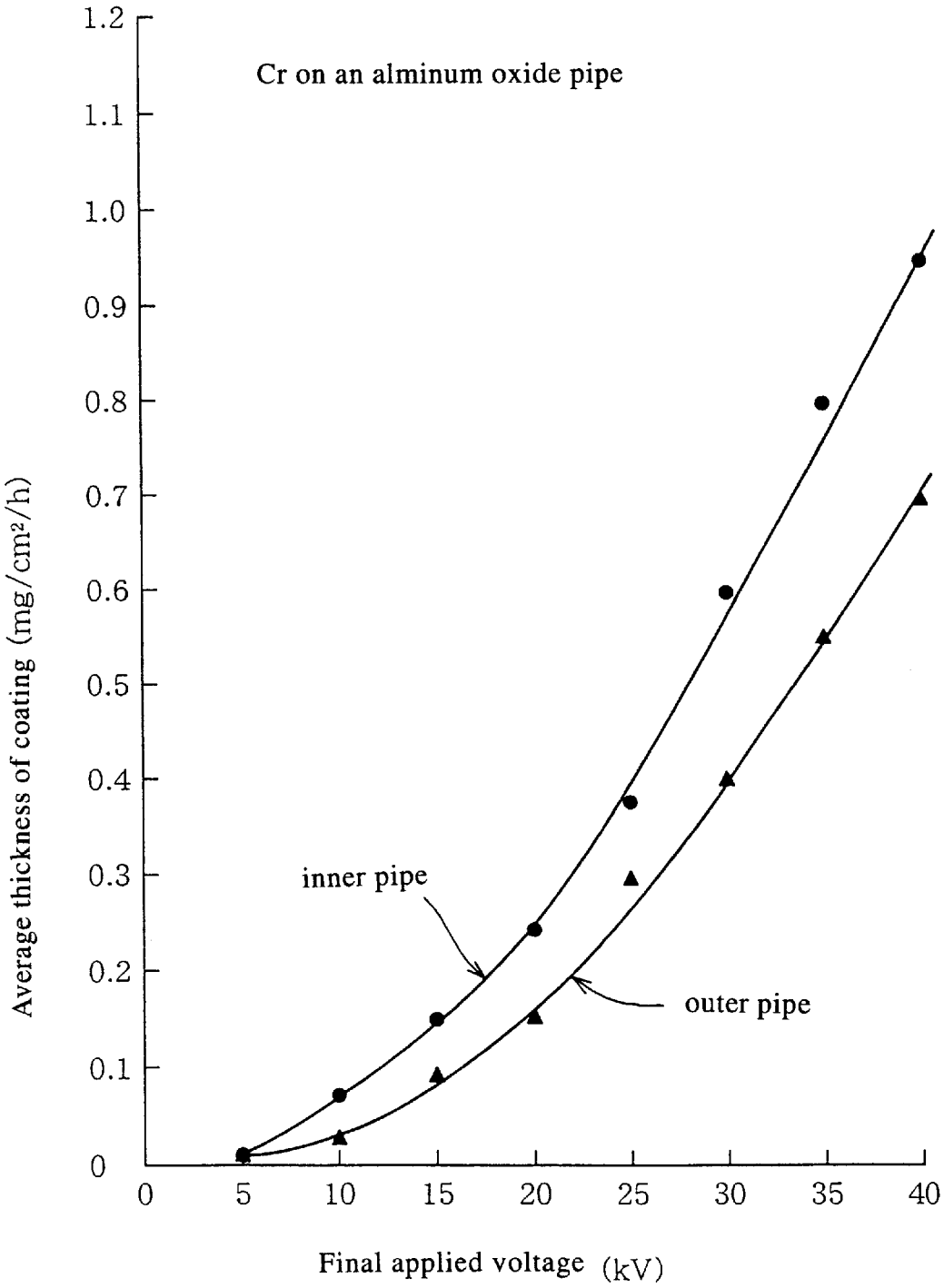
FIG. 8 is a graph showing the relationship between final applied voltage and the average amount of Cr coatings in Example 4.

The obtained results of measurement are shown in FIG. 8. In FIG. 8, the horizontal axis denotes the final applied voltage between the electrodes 21 and 22, and the vertical axis denotes the average thickness of the coatings in terms of the amount of coatings per hour per unit area ($\mu$g/cm$^2$/h). As shown in FIG. 8, it was proved that the coating thickness increased with the increase of the final applied voltage.

Electric power consumed in the above operation was about 8 W/hr.

EXAMPLE 5

A ceramic hollow pipe and a ceramic cylinder were coated with Cr using the substrate coating apparatus shown in FIG. 4 at ambient temperature.

That is, a transparent acrylic disk used as an insulating disk plate 104 having a diameter of 40 mm, and a thickness of 10 mm was first placed on a support stand 106, and 400 mg of Cr micro-particles having an average particle size of 30 $\mu$m were heaped on the transparent acrylic disk used as the insulating disk 104. Next, a protrusion portion of a brass columnar pipe of 10 mm in diameter and 0.5 m in length which was used as an electrode 102 was inserted into a concave portion formed at the center of the transparent acrylic disk. Outside the brass pipe, a ceramic hollow pipe of 16 mm in outer diameter, 10 mm in inner diameter, and 0.5 m in length (inner cylindrical pipe 120) and a brass cylindrical electrode 101 of 40 mm in outer diameter, 38 mm in inner diameter, and 0.5 m in length were placed concentrically.

A packing 109 was seated on the electrode 101, a transparent acrylic disk as the insulating disk 103 which was 50 mm in diameter and 10 mm in thickness was placed thereon. A packing 110 was seated in a packing recess formed at the center portion of the insulating disk 103, a nut 111 was screwed in and tightened to define the enclosed space.

Thereafter, the entire apparatus as assembled above was installed on a support stand 112 by holding the lower periphery of the hollow cylindrical electrode 101 through a packing 113.

Next, a lead wire 107 and a lead wire 108 were connected to the nut 111 and the electrode 101, respectively.

Thereafter, the enclosed space 130 was evacuated to $10^{-6}$ torr with a molecular pump.

Thence, an ac voltage of 1 kV was applied between the electrodes 102 and 101 which were disposed parallel to each other. The applied voltage was elevated to 3 kV at a rate of 200 V/min. When the strength of the electric field reached 3 kV/cm, the Cr micro-particles started to vibrate. The vibration of the Cr mirco-particles was confirmed by monitoring the scattered laser light from a YAG laser that transmitted the transparent disk plate 103 to illuminate the Cr micro-particles, from which it was scattered.

The applied voltage was further elevated to 25 kV, and when the strength of the electric field reached to 25 kV/cm, the voltage was kept for one hour as the final applied voltage.

Then, dried air was introduced into the enclosed space to return the inside of the enclosed space to 1 atmospheric pressure, and the outer pipe 120 and the inner pipe 121 were taken out. The average thickness of the coatings formed on an inner wall surface of the outer pipe 120 and an outer wall surface of the outer pipe 121 was measured with an analytical direct reading digital balance. The average thickness of the Cr coating on the inner wall surface of the inner pipe 120 was 0.21 mg/cm$^2$ (0.29 $\mu$m), and the average thickness of the Cr coating on the outer wall surface of the inner pipe 121 was 0.41 mg/cm$^2$ (0.57 $\mu$m). The thickness distribution of the coatings was within ±5% on both the inner wall surface of the outer pipe 120 and the outer wall surface of the inner pipe 121, therefore, it was proved that the present invention could provide sufficient uniform coating.

Electric power consumed in the above operation was about 8 W/hr.

According to the present method for coating the substrate, a coating having excellent adhesion to the substrate and having high density can be obtained because the powder particles having high energy can cover the substrate.

According to the present method for coating the substrate, the coating in which the performance of the coating substance itself is not lost can be obtained because coating is carried out at ambient temperature.

According to the present method for coating the substrate, the coating can be obtained with low electric power.

Further according to the present method for coating the substrate, the residual unused substance can be easily recovered with high recovery ratio because the coatings are formed in the enclosed space, and the residual coating substance is not lost to the outside. Therefore, it is concluded that the present method for coating the substrate is economically preferred and is acceptable in preservation of environment.

Further according to the present method for coating the substrate, a silicon coating can be formed on a non-conductive substrate at high rate.

Further according to the present method for coating the substrate, a uniform coating can be formed on an inner wall surface of a hollow cylinder and a wall surface of a column, as well as on substrates having complex shapes. For example, a coating can be formed on maskings having various kinds of figures and letters that are obtained by micro-machining a stainless steel plate using a photoetching method.

Further according to the present method for coating the substrate, coatings of various elements and compounds such as W, Hf, Ta, B, C, Os, Pd, Mo, Ir, ans Re and the like that have high melting point can be formed because the present method for coating of the substrate does not depend on the melting temperature of the coating substance.

Further according to the present method for coating the substrate, it is possible to form a mixed coating containing two elements or three elements, i.e., different kinds of substances, or a complex hybrid-type coating consisting of alternating layers of different kinds of substances.

Further according to the present method for coating the substrate, coatings of compounds such as TaN and AlC, alloys, magnetic metal micro-powder particles, super-conductive alloys or compounds, shape memory effect alloys as well as magnetic alloys can be applied.

Therefore, the present method for coating the substrate is expected to find application in a wide variety of fields such as machinery industry, electronic industry, vacuum science, accelerator, aerospace engineering, marine resources development industry, and automobile industry. Furthermore, the present method of coating the substrate can be applied to functional coating technologies such as reinforcement of surface properties, lengthening of surface lifetime, and modification of surfaces by selecting the inherent characteristic properties of various metal elements.

The present invention is not limited to the above embodiments and examples, and a person skilled in the art appreciates that various modifications may be possible within the scope of the present invention referred by attached claims. Such modifications of course will be included in the scope of the present invention.

All of the publications, patents, and patent applications referred herein are incorporated herewith as references.

What is claimed is:

1. A method for coating a substrate comprising the steps of:

disposing a non-conductive substrate within a space that is enclosed;

introducing particles of a coating material within said space, said space being defined by at least a pair of electrodes and an insulating member inserted between said electrodes, wherein said non-conductive substrate covers at least one electrode of said at least a pair of electrodes; and vibrating said particles by applying an ac voltage between said electrodes so as to coat said non-conductive substrate with said coating material.

2. The method according to the claim 1, further including the step of evacuating said space prior to applying said ac voltage between said electrodes, said space being defined by at least said pair of electrodes and said insulating member inserted between said electrodes.

3. The method according to the claims 1 or 2, wherein said non-conductive substrate has a plate shape, and said pair of electrodes are placed opposite to each other.

4. The method according to the claims 1 or 2, wherein said non-conductive substrate has a cylindrical shape, and said pair of electrodes are placed concentrically opposite to each other.

5. The method according to claim 1, wherein said non-conductive substrate is selected from the group consisting of polymer, porcelain, ceramics, ceramic fiber, silica, glass epoxy, wood, rubber, and fiber.

6. The method according to claim 1, wherein said coating material is a metal or a metal compound.

7. The method according to claim 1, wherein said coating material is a super-conductive alloy or a super-conductive compound.

8. The method according to the claim 7, wherein said coating material is a high temperature super-conductive compound.

9. The method according to claim 1, wherein said particles have a particle size of 0.05 to 300 $\mu$m.

10. The method according to claim 1, wherein a peak value of said ac voltage is 2 kV to 80 kV.

11. The method according to claim 1, wherein a frequency of said ac voltage is 50 Hz to 60 MHz.

12. The method according to claim 2, wherein said space defined by at least said pair of electrodes and said insulating member inserted between said electrodes is evacuated to $10^{-2}$ torr or less.

13. The method according to claim 1, wherein said ac voltage is applied so that a kinetic energy of not less than $1\times10^5$ eV is imparted to said particles.

14. The method according to claim 1, wherein said insulating member is selected from the group consisting of glass, polytetrafluoroethylene, polyimide, and porcelain.

15. The method according to claim 1, wherein the coating of said substrate is carried out at ambient temperature.

16. The method according to claim 1, wherein the amount of said particles per unit surface area of the coating surface of said non-conductive substrate is 0.1 to 100 $mg/cm^2$.

* * * * *